US007140651B2

(12) United States Patent
Brose

(10) Patent No.: US 7,140,651 B2
(45) Date of Patent: Nov. 28, 2006

(54) MOTOR VEHICLE LOCK, ESPECIALLY FOR A TRUNK LID OF A TAILGATE OF A MOTOR VEHICLE

(75) Inventor: Simon Brose, Hattingen (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 178 days.

(21) Appl. No.: 11/008,561

(22) Filed: Dec. 10, 2004

(65) Prior Publication Data

US 2005/0146144 A1 Jul. 7, 2005

(30) Foreign Application Priority Data

Dec. 10, 2003 (DE) ..... 103 58 139

(51) Int. Cl.
*E05C 3/12* (2006.01)
*E05C 3/16* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS 5,938,253 A * 8/1999 Szablewski et al. ..... 292/216
6,439,623 B1 * 8/2002 Lohfeld et al. ..... 292/201
6,698,805 B1 3/2004 Erices et al.

FOREIGN PATENT DOCUMENTS

DE 41 19 703 C1 10/1992

* cited by examiner

*Primary Examiner*—Brian E. Glessner
*Assistant Examiner*—K. Gluchowski
(74) *Attorney, Agent, or Firm*—David S. Safran

(57) ABSTRACT

A motor vehicle lock for a trunk lid or a tailgate of a motor vehicle. In this motor vehicle lock, two driver elements are provided on a disk-shaped driving element and they implement different speed reduction ratios with respect to the ratchet. In this way, an optimum, staggered starting characteristic is produced; moreover, construction effort and costs are minimized.

11 Claims, 4 Drawing Sheets

MOTOR VEHICLE LOCK, ESPECIALLY FOR A TRUNK LID OF A TAILGATE OF A MOTOR VEHICLE

BACKGROUND OF THE INVENTION

1. Field of Invention

The present invention relates to a motor vehicle lock, and, more specifically to a motor vehicle door lock for a trunk lid or a tailgate of a motor vehicle.

2. Description of Related Art

Known motor vehicle locks, designed and suitable for a trunk lid or the tailgate of a motor vehicle as described in German Patent Application DE 195 05 779 A1 (which corresponds to U.S. Pat. No. 5,938,253) are advantageous because an electric motor drive can be controlled without a reset spring by a driving element which rotates in one rotational direction in blocking operation, and thus, without microswitches.

The known motor vehicle lock noted above is made such that, when the electric motor drive fails, emergency actuation by hand enables the ratchet to be moved, at any time, into the lifted position. Overall, for the mechanical background of motor vehicle locks of the type under consideration, and for the particulars in motor vehicle locks for trunk lids or tailgates, reference should be made to U.S. Pat. No. 5,938,253, the contents of which are incorporated by reference in their entirety.

In the above-described known motor vehicle lock, a driver element is described as a cylindrical component. For the purposes of this application, however, a crank-like component or a component with some other shape, such as an elliptical shape, can also be regarded as the driver element. As in the prior art, the drive is provided with a degressive starting characteristic. This means that, upon starting, a large torque can be applied in order to release the ratchet from the engagement position on the latch. As the lifting motion of the ratchet continues, this torque is continuously reduced by the shape of the driver element. In particular, a control crank in the shape of a helical cam as a driver element has come into use as shown in German Patent Application DE 101 00 008 A1 (which corresponds to U.S. Pat. No. 6,698,805). In this respect, implementation of stepped reduction of the torque by lever action arms of different length is also known as shown in German Patent DE 41 19 703 C1. This is not implemented with the driving element of an electric motor drive in which the driving element rotates in one direction. However, in a motor vehicle lock with manual actuation, it is implemented via a gradually acting coupling of the opening handle to the ratchet.

SUMMARY OF THE INVENTION

A primary object of the present invention is to optimize the opening function of a motor vehicle lock by consideration of the particulars of an electric motor drive with a driving element which rotates in one direction and with implementation of block operation for driving.

The aforementioned object is achieved in a motor vehicle lock where a driving element of the electric motor drive, embodied as a drive wheel, is provided with two driver elements, i.e. driver journals. The journals are located in different positions, especially in a different radial position on the driving element. The second driver element is preferably a control crank which is shaped like a helical cam and executes the actual lifting of the ratchet with a great force on the ratchet, therefore has a large reduction ratio. The first driver element is relieved of its function of lifting of the ratchet and implements overtravel motion of the ratchet and a block operation only with little force on the ratchet, but with a comparatively higher speed.

Thus, it is possible, in a manner which is especially suitable for an electric motor drive with a driving element which rotates in one direction, to implement a two-stage opening motion of the ratchet without the need to introduce additional levers. This means that a large force for lifting the ratchet is available, but it is then gradually reduced to the benefit of the path which is to be quickly traversed. With the type of speed reduction on the driving element provided by the present invention, large holding forces on the latch can be overcome with a comparative small electric drive motor, as is normally used for centralized locking system drives.

The present invention is explained in detail below using the drawings with reference to one preferred embodiment or preferred embodiments. In the course of these explanations other embodiments and developments and other features, properties, aspects and advantages of the invention are explained at the same time.

DETAILED DESCRIPTION OF THE INVENTION

In the figures, the same reference numbers are used for the same or similar parts. Thus, it should be indicated that the corresponding or comparable properties and advantages are achieved, even if a repeated description of these parts is omitted.

Figure 1:
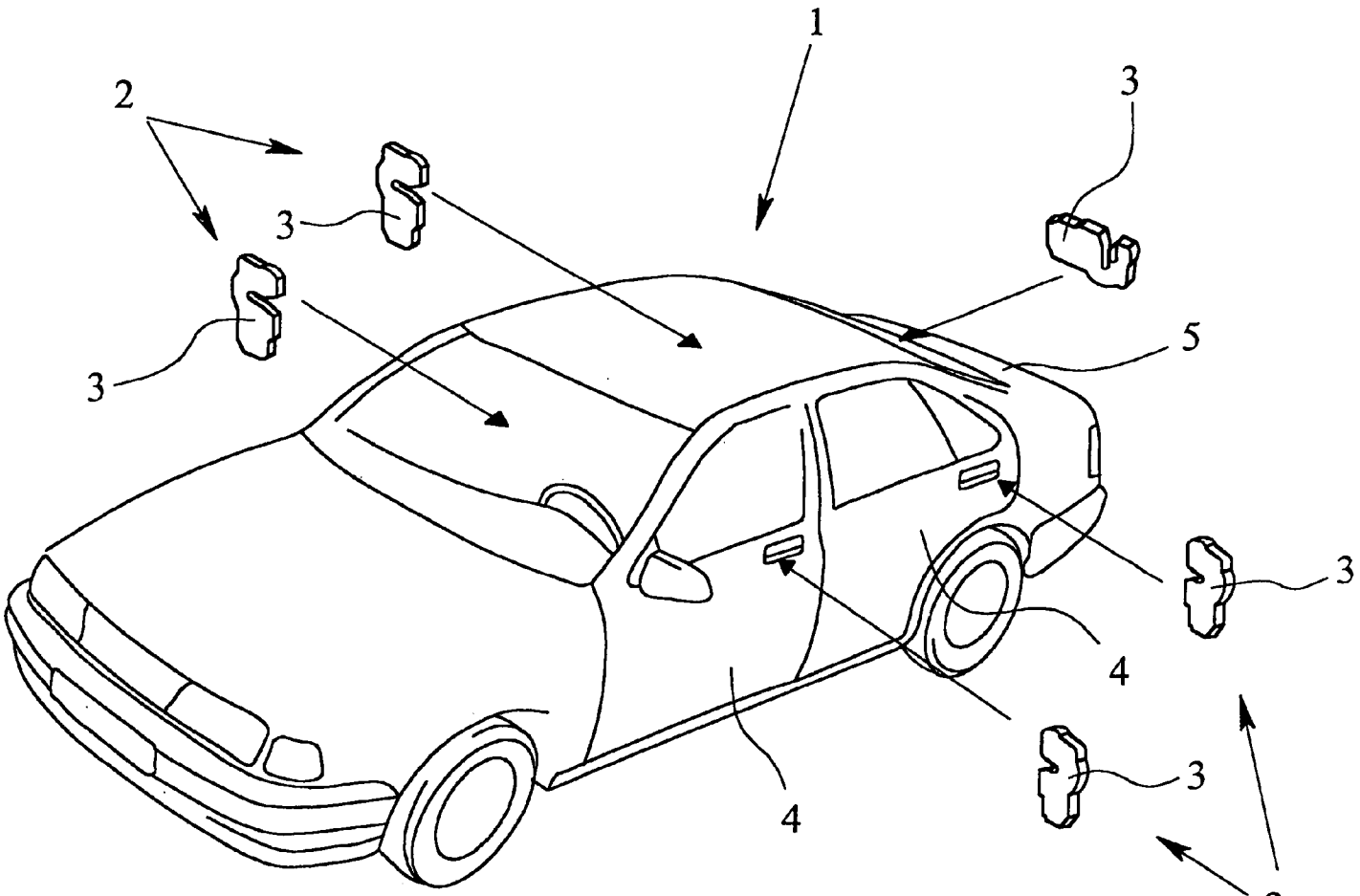
FIG. 1 shows a schematic perspective of a motor vehicle with a motor vehicle locking system.

FIG. 1 shows in a schematic a motor vehicle 1 with a motor vehicle locking system 2 which is indicated only in part. The system can include several motor vehicle locks 3, specifically those for side doors 4, for a trunk lid 5, optionally for a rear hatch or tailgate, but also for a glove box, a fuel tank cover or the like. In accordance with the present invention, the installation positions of the motor vehicle locks 3 are schematically indicated by the arrows in FIG. 1.

In this embodiment, the motor vehicle locks 3 can be actuated by a motor, which also can be locked and unlocked by an electric motor, and/or which can be opened by an electric motor.

Figure 2:
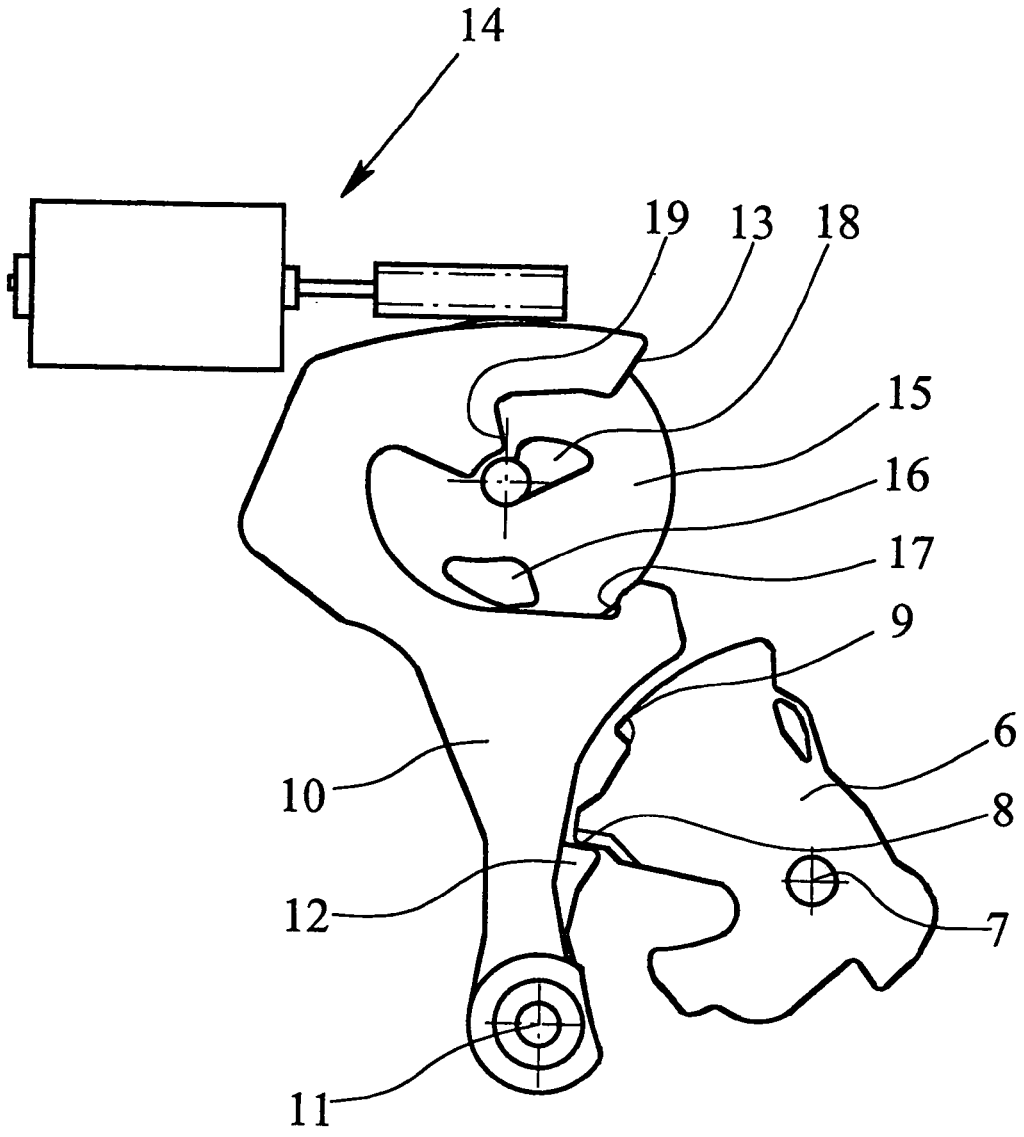
FIG. 2 shows an embodiment of a motor vehicle lock as provided by the present invention, made as a lock for a tailgate, with the latch in the main locked position and the ratchet engaged.
Figure 3:
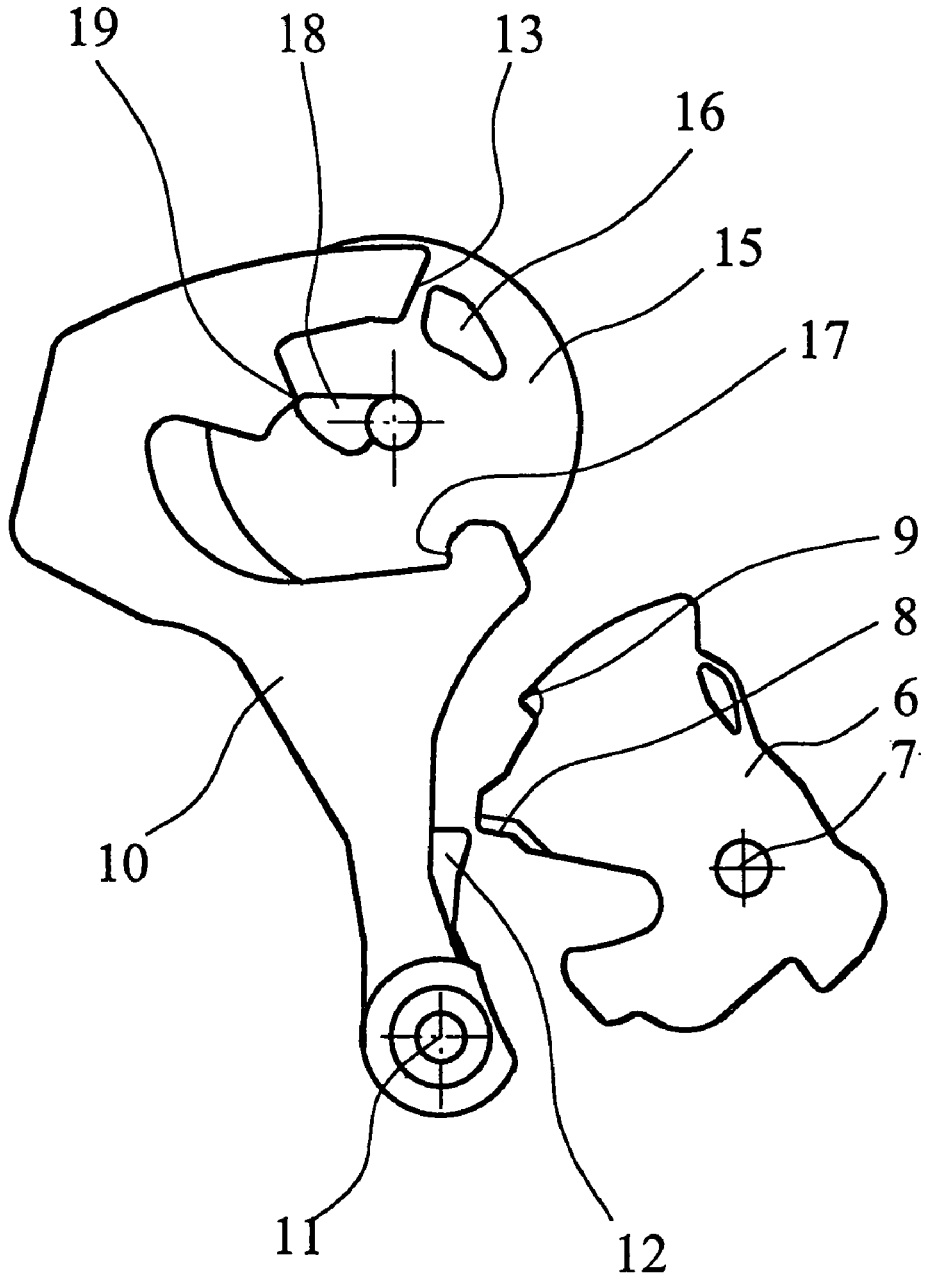
FIG. 3 shows the embodiment of FIG. 2, with the ratchet in the lifted position.
Figure 4:
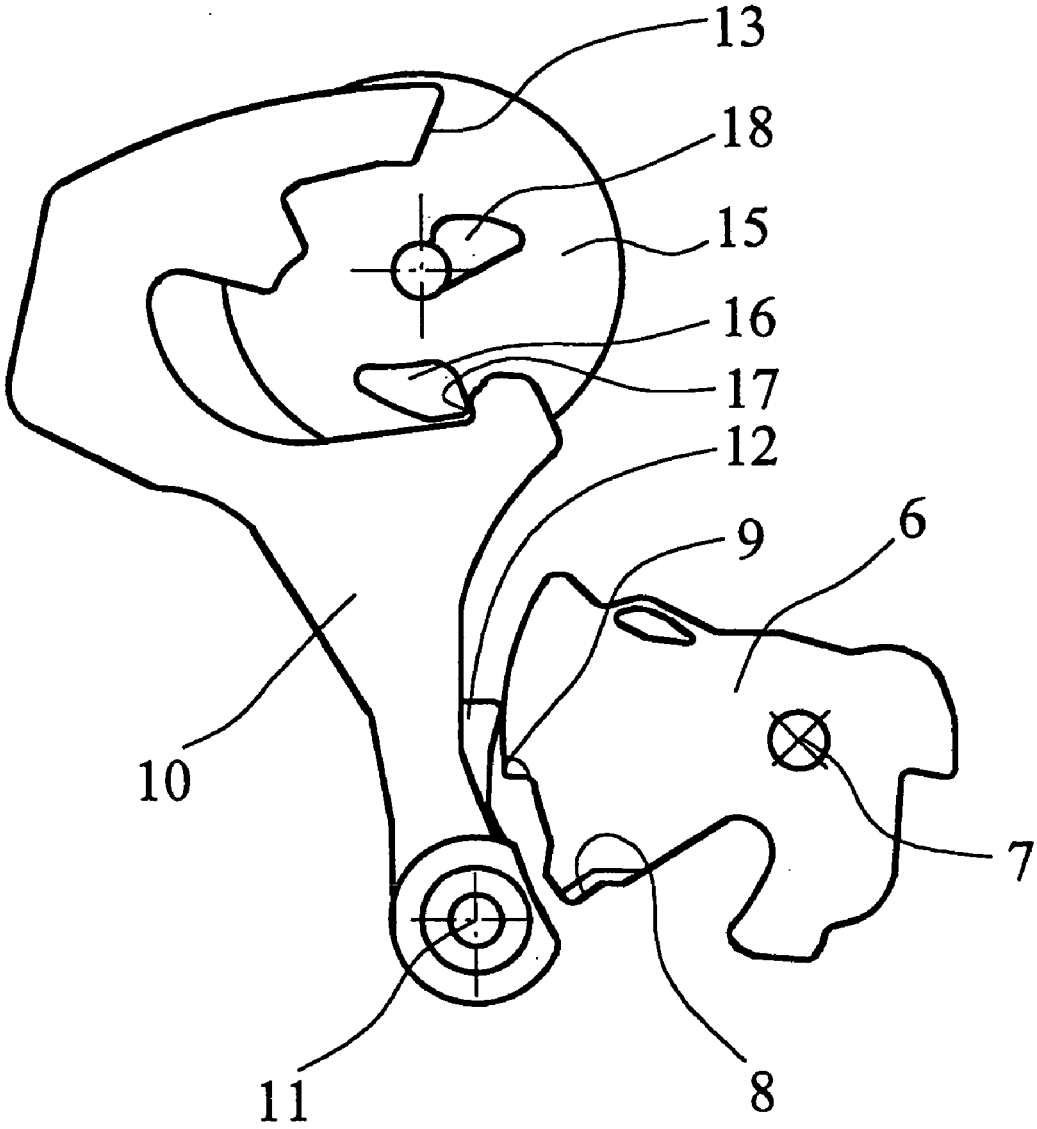
FIG. 4 shows the embodiment of FIG. 2, with the drive turned off by a blocking operation.

FIGS. 2 to 4 show a motor vehicle lock, in accordance with an exemplary embodiment of the present invention, which can be employed with a trunk lid or a tailgate of a motor vehicle. FIG. 2 shows the closed position of the motor vehicle lock. FIG. 3 shows the lifted position and FIG. 4 shows the block disengagement for the motor vehicle lock.

The illustrated motor vehicle lock includes a latch 6 which, in this embodiment and according to the most common version, is a rotary latch. On the latch 6, which is pivotally supported on a swivelling axle 7, there is a main catch 8 which is used in a main locking position of the latch 6 and a preliminary catch 9 which is used in a preliminary locking position of this latch 6. The latch 6 could also be employed without the preliminary catch 9.

The latch 6 is kept in the main locking position and, in this embodiment, also in the preliminary locking position by a ratchet 10. The ratchet 10 is pivotally supported on a pivot axis 11 and locks with the main catch 8 or the preliminary catch 9 of the latch 6 by means of a corresponding catch projection 12. The locking elements of the motor vehicle lock, in this embodiment, are jacketed with plastic or are made partially as plastic parts, the power transmission areas which engage being exposed in the metal.

The illustrated embodiment shows that the ratchet 10 is an integral part. However, fundamentally, the ratchet 10 can also be coupled to another catch lever which then transfers the movements to the ratchet 10.

On the ratchet 10, or even on a catch lever which is coupled to the ratchet, there is an actuating surface 13 at a distance from the engagement point to the latch 6, and at a distance from the catch projection 12. Furthermore, there is an electric motor drive 14 with a driving element 15, which is preferably a driving wheel as illustrated, and which rotates in one direction (in this embodiment counterclockwise). A driver element 16 is arranged eccentrically on this driving element 15. Other driving elements, for example, have a lobe shape or elliptical shape or also simply the shape of a one-armed pivot lever.

By turning the driving element 15, the driver element 16 strikes the actuating surface 13, moves the ratchet 10 into an overtravel position beyond a lifted position, and afterwards runs past the actuating surface 13. This movement transitions from the state in FIG. 3 to the state in FIG. 4 in a counterclockwise direction. The lifted position of the ratchet 10 is the position in which the catch projection 12 does not engage the main catch 8 or the preliminary catch 9 of the latch 6. The latch 6 can therefore easily swivel out around its swivelling axle 7 in a counterclockwise direction to the open position.

For the latch 6 and the ratchet 10, there are spring elements which pretension them into the respective set position; the latch 6 into the open position, and the ratchet 10 into the engagement position. The springs can also be replaced by a single spring which acts on both locking elements. In this regard, reference should be made to the prior art which was explained at the beginning.

On the ratchet 10, a catch lever which is coupled to the ratchet 10, or also on a blocking lever which is separate from the ratchet 10, but dynamically coupled to it, a driver stop surface 17 is provided at a distance beyond the actuating surface 13 viewed in the direction of rotation of the driving element 15. The driver stop surface 17, when the ratchet 10 is in the lifted position, is in the path of motion of the driver element 16 (shown in FIG. 4). However, when the ratchet 10 is in the engagement position, the driver stop surface 17 is outside of the path of motion of the driver element 16 (illustrated in FIG. 2).

When the latch 6 is in the open position, the latch 6 keeps the ratchet 10 in the lifted position (FIG. 4). In this way, it is possible for the driver element 16, after running past the actuating surface 13 when the ratchet 10 is in the lifted position, to strike the stop surface 17. In this way, the electric motor drive is turned off in a blocking operation. The ratchet 10 and the catch lever or the separate blocking lever are fixed by the latch 6 so that the necessary resistance force against the starting of the driver element 16, which can be used for the blocking operation, arises.

The blocking operation means disengagement by monitoring the torque, monitoring the current, monitoring the time or a combination of difference types of monitoring. Reference should also be made to the prior art for further details.

In accordance with an exemplary embodiment of the invention, the driver element 16 does not perform the actual lifting of the ratchet 10 out of the engagement position on the latch 6. On the driving element 15, there is a second eccentrically arranged driver element 18 and, on the ratchet 10 or the catch lever, there is an opening control surface 19 which interacts with the second driver element 18. When the drive 14 starts to lift the ratchet 10 out of the main locking position, the second driver element 18 first engages the opening control surface 19 and only afterwards does the first driver element 16 engage the actuating surface 13. The effective speed reduction ratio with respect to the second driver element 18 is larger than with respect to the first driver element 16. By this division into the first driver element 16 and the second driver element 18, optimum application of torque to the ratchet 10 at the start of the lifting motion is combined with fast motion of the ratchet 10 at the end of the lifting motion, especially in overtravel. This graduated starting characteristic, which is implemented by double lever action in the prior art, is implemented in the present invention by using another driver element 18 on the driving element 15. The implementation of another driver element in accordance with the present invention is feasible and economical.

The illustrated embodiment which is preferred in this respect, otherwise shows that the ratchet 10 or the catch lever is arranged overlapping with the driving element 15 and that the first driver element 16 is located radially farther to the outside on the driving element 15 than the second driver element 18. The different lever arm ratios can be employed and they lead to the desired different speed reducing action.

Furthermore, in this embodiment, it is provided that the opening control surface 19 is farther away from the engagement point to the latch 6 than the stop surface 17. In fact, the stop surface 17 is near the lower reversal point of the first driver element 16, if the ratchet 10 is in the lifted position (FIG. 4). In this way, the stop surface 17 acts on the ratchet 10 with the shortest possible lever arm with respect to the pivot axis 11, so that, in this respect, the blocking action of the stop surface 17 is accompanied by the smallest possible action of force between the latch 6 and the ratchet 10, so that the entire bending stress on the ratchet 10 is kept as small as possible.

The illustrated and preferred embodiment furthermore shows a crank-like configuration of the second driver element 18 such that the second driver element 18 proceeds from one point near the center point of the driving element 15. Here, it is provided that the second driver element 18 is a control crank with the shape of a helical cam.

The illustrated and preferred embodiment has another aspect where the two driver elements 16, 18 lie on one side of the driving element 15, and can also be in one plane with respect to the ratchet 10 or the catch lever or the blocking lever. Because the two driver elements 16, 18 lie in one plane, the force is applied to the ratchet 10 or the catch lever or the blocking lever very effectively.

Finally, FIG. 3 shows one particular aspect of the illustrated embodiment of a motor vehicle lock as provided in the present invention which is established in that the first driver element 16 only engages the actuating surface 13 after the lifting of the ratchet 10 has been completed by the second driver element 18. Here, transfer from one driver element to the other therefore takes place. Basically, it would also be possible to make the influencing action overlapping, of course its having to be considered that no static matching occurs.

What is claimed is:

1. Motor vehicle lock comprising:

a latch, a ratchet which keeps the latch in a main locking position;

an actuating surface located on the ratchet at a distance from an engagement point with the latch;

an electric motor drive with a driving element which rotates in one direction and which has first and second driver elements arranged eccentrically thereon;

an opening control surface located on the ratchet that interacts with the second driver element, wherein by rotating the driving element, the first driver element strikes the actuating surface, moving the ratchet into an overtravel position beyond a lifted position of the ratchet, and then runs past the actuating surface;

a driver stop surface located on the ratchet at a distance beyond the actuating surface viewed in the direction of rotation of the driving element, wherein, when the ratchet is in the lifted position, the driver stop surface is in the path of motion of the first driver element, but when the ratchet is in the engagement position, the driver stop surface is outside of the path of motion of the first driver element, the latch which is in the open position keeping the ratchet in the lifted position and the first driver element, after running past the actuating surface when the ratchet is in the lifted position, striking the stop surface and turning off the electric motor drive, wherein when the drive begins to lift the ratchet out of a main locking position, the second driver element engages the opening control surface then the first driver element engages the actuating surface, and wherein an effective speed reduction ratio with respect to the second driver element is larger than with respect to the first driver element.

2. The motor vehicle lock of claim 1, wherein the ratchet is arranged overlapping in space with the driving element and wherein the first driver element is located radially farther to the outside on the driving element than the second driver element.

3. The motor vehicle lock of claim 2, wherein the opening control surface is located further away from the engagement point relative to the latch than the stop surface.

4. The motor vehicle lock of claim 1, wherein the second driver element extends from a point near the center point of the driving element.

5. The motor vehicle lock of claim 3, wherein the second driver element extends from a point near the center point of the driving element.

6. The motor vehicle lock of claim 1, wherein the second driver element is a control crank with the shape of a helical cam.

7. The motor vehicle lock of claim 5, wherein the second driver element is a control crank with the shape of a helical cam.

8. The motor vehicle lock of claim 1, wherein the first and second driver elements lie on one side of the driving element.

9. The motor vehicle lock of claim 1, wherein the first driver element only engages the actuating surface after the lifting of the ratchet by the second driver element has been completed.

10. The motor vehicle lock of claim 3, wherein the stop surface is located towards a lower reversal point of the first driver element.

11. The motor vehicle door lock of claim 8, wherein the first and second driver elements are located in one plane with respect to the ratchet.

* * * * *